US007340847B2

(12) United States Patent
Kim

(10) Patent No.: US 7,340,847 B2
(45) Date of Patent: Mar. 11, 2008

(54) CLOTHES DRYING MACHINE

(75) Inventor: Jin Doo Kim, Suwon-Si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 39 days.

(21) Appl. No.: 11/175,220

(22) Filed: Jul. 7, 2005

(65) Prior Publication Data

US 2006/0112590 A1 Jun. 1, 2006

(30) Foreign Application Priority Data

Dec. 1, 2004 (KR) ..... 10-2004-0099925

(51) Int. Cl.
*F26B 11/02* (2006.01)

(52) U.S. Cl. ..... 34/601

(58) Field of Classification Search ..... 34/601, 34/602, 603, 604; 68/24
See application file for complete search history.

(56) References Cited

U.S. PATENT DOCUMENTS 5,203,093 A * 4/1993 Baker ..... 34/601
5,555,647 A * 9/1996 Torborg et al. ..... 34/601
6,874,248 B2 * 4/2005 Hong et al. ..... 34/239

FOREIGN PATENT DOCUMENTS

KR 2002-0062448 A 7/2002
KR 10-2004-0065477 A 7/2004

* cited by examiner

*Primary Examiner*—S. Gravini
(74) *Attorney, Agent, or Firm*—Sughrue Mion, PLLC

(57) ABSTRACT

A clothes drying machine, in which a connection structure between an air blowing case and a motor bracket is simplified so that the number of required components is reduced and assembly efficiency is improved, and the air blowing case is precisely connected to the motor bracket so that the generation of noise or vibration is reduced. The clothes drying machine has an air blowing device including an air blast fan and an air blowing case; a driving motor installed proximate to the air blowing case for driving the air blast fan; a motor bracket for fixing the driving motor; a support portion extended from the motor bracket for fixing the air blowing case and determining the position of the air blowing case; first insertion portions, formed on an outer surface of the air blowing case, into which the end of the support portion is inserted; and a second insertion portion protruded from the outer surface of the air blowing case at a position separated from the first insertion portions for fixing the air blowing case.

8 Claims, 4 Drawing Sheets

CLOTHES DRYING MACHINE

CROSS-REFERENCE TO RELATED APPLICATION

This application claims priority from Korean Patent Application No. 2004-99925, filed Dec. 1, 2004, in the Korean Intellectual Property Office, the disclosure of which is incorporated herein by reference.

BACKGROUND OF THE INVENTION

1. Field of the Invention

The present invention relates to a clothes drying machine and, more particularly, to a clothes drying machine having an improved connection structure between a case of an air blowing device and a motor bracket.

2. Description of the Related Art

A general drum-type clothes drying machine allows hot air to pass through the inside of a rotary drum under the condition that the rotary drum containing laundry is rotated at a low speed, thereby drying the laundry in the rotary drum. Korean Patent Laid-open Publication Nos. 2002-0062448 and 2004-0065477 disclose this type of clothes drying machine.

The above clothes drying machine comprises an air blowing device for blowing air to the inside of the rotary drum, a driving motor for simultaneously driving the air blowing device and the rotary drum, a suction channel for guiding air to be introduced into the rotary drum, and a discharge channel for guiding air to be discharged from the rotary drum to the outside. The driving motor is provided with a rotary shaft extended to both sides so that a pulley for rotating the rotary drum is installed at one end of the rotary shaft and the air blowing device is connected to the other end of the rotary shaft, thereby simultaneously driving the air blowing device and the rotary drum. The air blowing device includes an air blast fan installed on the shaft of the driving motor, and an air blowing case surrounding the air blast fan for guiding the blown air.

In this clothes drying machine, the air blowing device and the driving motor are installed in the lower part of an external case, and the driving motor is fixed through a motor bracket installed in the lower part of the external case. The motor bracket is fixed to the bottom surface of the external case through a plurality of fixing screws, and the air blowing case is fixed to the bottom surface of the external case through a plurality of fixing screws.

Further, the air blowing case and the motor bracket are in contact, and are fixed to each other by a plurality of fixing screws. That is, the air blowing case and the motor bracket are fixed to each other by the fixing screws under the condition that the rear surface of the air blowing case contacts one side of the motor bracket. This structure stably supports the air blowing case, thereby preventing the air blowing case from vibrating.

Since the air blowing case and the motor bracket are fixed to each other by the fixing screws, the clothes drying machine is disadvantageous in that there are many required components of the clothes drying machine and the assembly efficiency of the clothes drying machine is lowered due to steps of connecting the fixing screws during a manufacturing process.

When connection forces of the fixing screws are different due to carelessness of a worker or the clothes drying machine is not precisely assembled, the above connection structure of the air blowing case causes the vibration of the air blowing case, thus generating noise.

SUMMARY OF THE INVENTION

Therefore, one aspect of the invention is to provide a clothes drying machine having a simple connection structure of an air blowing case and a motor bracket, thereby reducing the number of components and improving assembly efficiency.

Another aspect of the invention is to provide a clothes drying machine, in which an air blowing case and a motor bracket are precisely assembled, thereby preventing the generation of noise or vibration.

In accordance with one aspect, the present invention provides a clothes drying machine comprising an air blowing device including an air blast fan and an air blowing case; a driving motor installed proximate to the air blowing case for driving the air blast fan; a motor bracket for fixing the driving motor; a support portion extended from the motor bracket for fixing the air blowing case and determining the position of the air blowing case; first insertion portions, formed on an outer surface of the air blowing case, into which the end of the support portion is inserted; and a second insertion portion protruded from the outer surface of the air blowing case at a position separated from the first insertion portions for fixing the air blowing case.

The clothes drying machine may further comprise an insertion hole formed through the support portion at a position corresponding to that of the second insertion portion.

Further, the motor bracket may include a base portion fixed to an external case of the clothes drying machine; and the support portion may include a first support portion and a second support portion upwardly extended from both sides of the base portion.

Moreover, the first insertion portions may be formed at positions corresponding to the first and second support portions respectively, and have cap structures surrounding ends of the first and second support portions.

The support portion may further include a motor support portion extended upwardly from the base portion at a position between the first and second support portions for supporting the driving motor; and the insertion hole may be formed through the motor support portion.

Further, the second insertion portion may be a protrusion having a hook structure inserted and latched onto the insertion hole.

The air blowing case may include a body portion surrounding the circumference of the air blast fan, and a rear plate covering the rear surface of the body portion and fixed to the support portion extended from the motor bracket; and the first and second insertion portions may be formed on the rear plate.

Further, the rear plate and the first and second insertion portions may be integrally formed by injection molding a resin.

BRIEF DESCRIPTION OF THE DRAWINGS

These and/or other aspects and advantages of the invention will become apparent and more readily appreciated from the following description of the exemplary embodiments, taken in conjunction with the accompanying drawings, in which.

Figure 1:
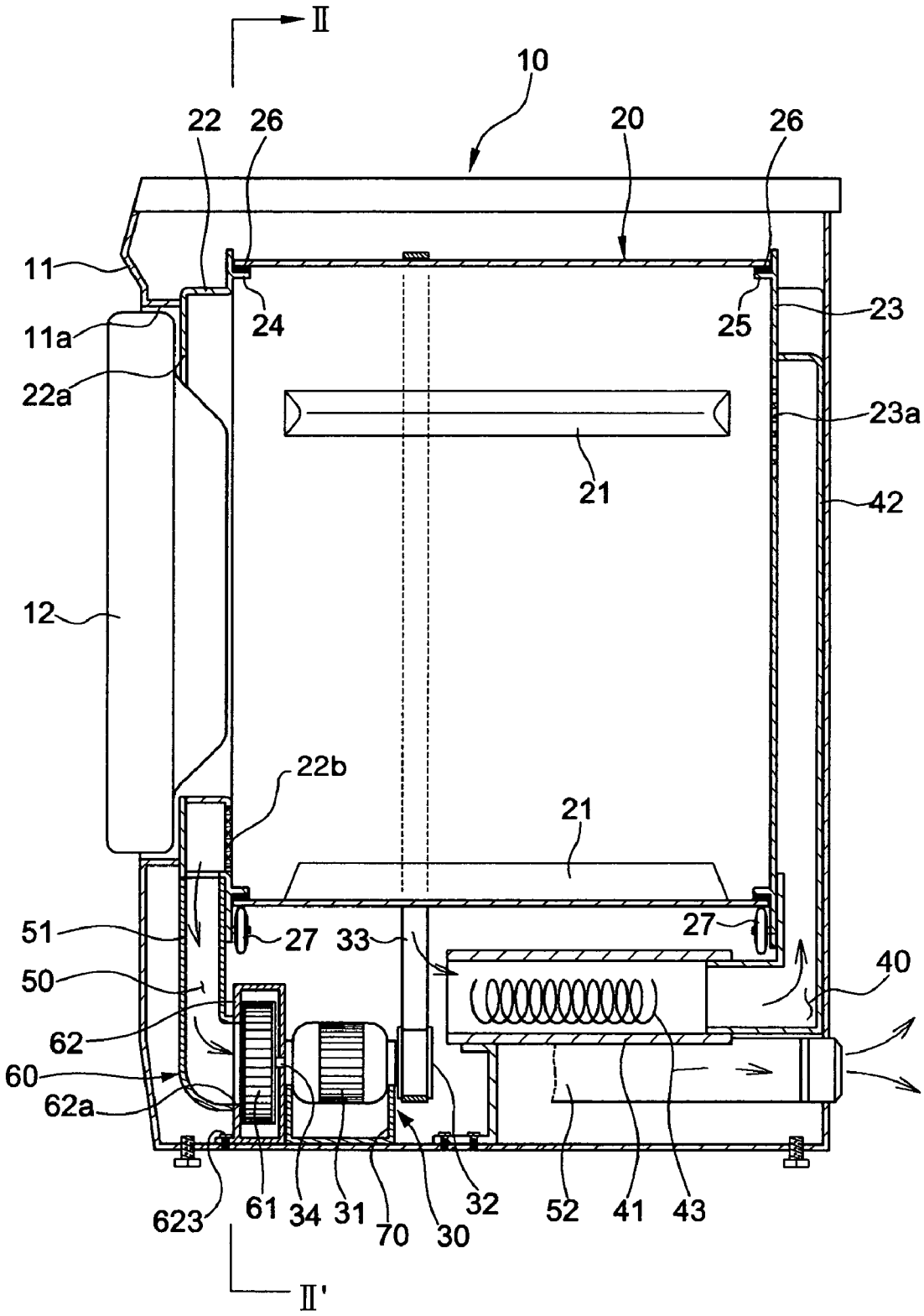
FIG. 1 is a sectional view of a clothes drying machine consistent with the present invention.

DETAILED DESCRIPTION OF THE ILLUSTRATIVE, NON-LIMITING EMBODIMENTS OF THE INVENTION

Reference will now be made in detail to an illustrative, non-limiting embodiment of the present invention, an example of which is illustrated in the accompanying drawings, wherein like reference numerals refer to like elements throughout. The exemplary embodiment is described below to explain the present invention by referring to the accompanying drawings.

As shown in FIG. 1, the clothes drying machine of the present invention comprises a rotary drum 20 rotatably installed in an external case 10, a driving device 30 for rotating the rotary drum 20, a suction channel 40 and a discharge channel 50 for circulating air to the inside of the rotary drum 20, and an air blowing device 60.

The rotary drum 20 has a cylindrical structure, front and rear surfaces of which are opened, and includes a plurality of lifters 21 protruded in a mountain shape from the inner surface thereof for lifting laundry and then dropping the laundry. A front support plate 22 and a rear support plate 23, which are installed in the external case 10, are respectively fixed to the insides of the front and rear surfaces of the external case 10 such that the front and rear support plates 22 and 23 rotatably support front and rear opened surfaces of the rotary drum 20 and cover the front and rear opened surfaces of the rotary drum 20.

A front support protrusion 24 and a rear support protrusion 25 are respectively formed on the front support plate 22 and the rear support plate 23, and are protruded such that the front and rear support protrusions 24 and 25 respectively enter the front and rear opened surfaces of the rotary drum 20, thereby rotatably supporting the front and rear opened surfaces of the rotary drum 20. Friction-relieving members 26 made of non-woven fabric for damping friction between the front support protrusion 24 and the rotary drum 20 and between the rear support protrusion 25 and the rotary drum 20 when the rotary drum 20 is rotated are interposed between the front support protrusion 24 and the rotary drum 20 and between the rear support protrusion 25 and the rotary drum 20, and rollers 27 for supporting the lower part of the rotary drum 20 are installed at the lower parts of the front and rear support plates 22 and 23.

Openings 11*a* and 22*a* through which laundry is inserted into or taken out of the inside of the rotary drum 20 are respectively formed through a front surface 11 of the external case 10 and the front support plate 22, and a door 12 for opening and closing the openings 11*a* and 22*a* is installed on the front surface 11 of the external case 10.

The driving device 30 includes a driving motor 31 installed in the lower part of the external case 10, and a pulley 32 and a rotary belt 33 for transmitting the driving force of the driving motor 31 to the rotary drum 20. The rotary belt 33 is wound on the outer surface of the rotary drum 20 and the pulley 32 connected to a shaft 34 of the driving motor 31.

The suction channel 40 guides external air, thereby causing the external air to be introduced to the inside of the rotary drum 20. The suction channel 40 includes a lower suction duct 41 installed at a portion of the external case 10 below the rotary drum 20, and a rear suction duct 42 installed at the rear of the rear support plate 23 for connecting inlets 23*a* formed through the upper part of the rear support plate 23 and the lower suction duct 41. A heater 43 for heating inhaled air is installed in the lower suction duct 41.

The discharge channel 50 guides air in the rotary drum 20, thereby causing the air to be discharged to the outside of the rotary drum 20. The discharge channel 50 includes a front discharge duct 51 for connecting outlets 22*b* formed through the lower part of the front support plate 22 and an inlet of the air blowing device 60 installed below the rotary drum 20, and a rear discharge duct 52 installed in the lower part of the external case 10 for connecting an outlet of the air blowing device 60 and the outside of the rear surface of the external case 10.

Figure 2:
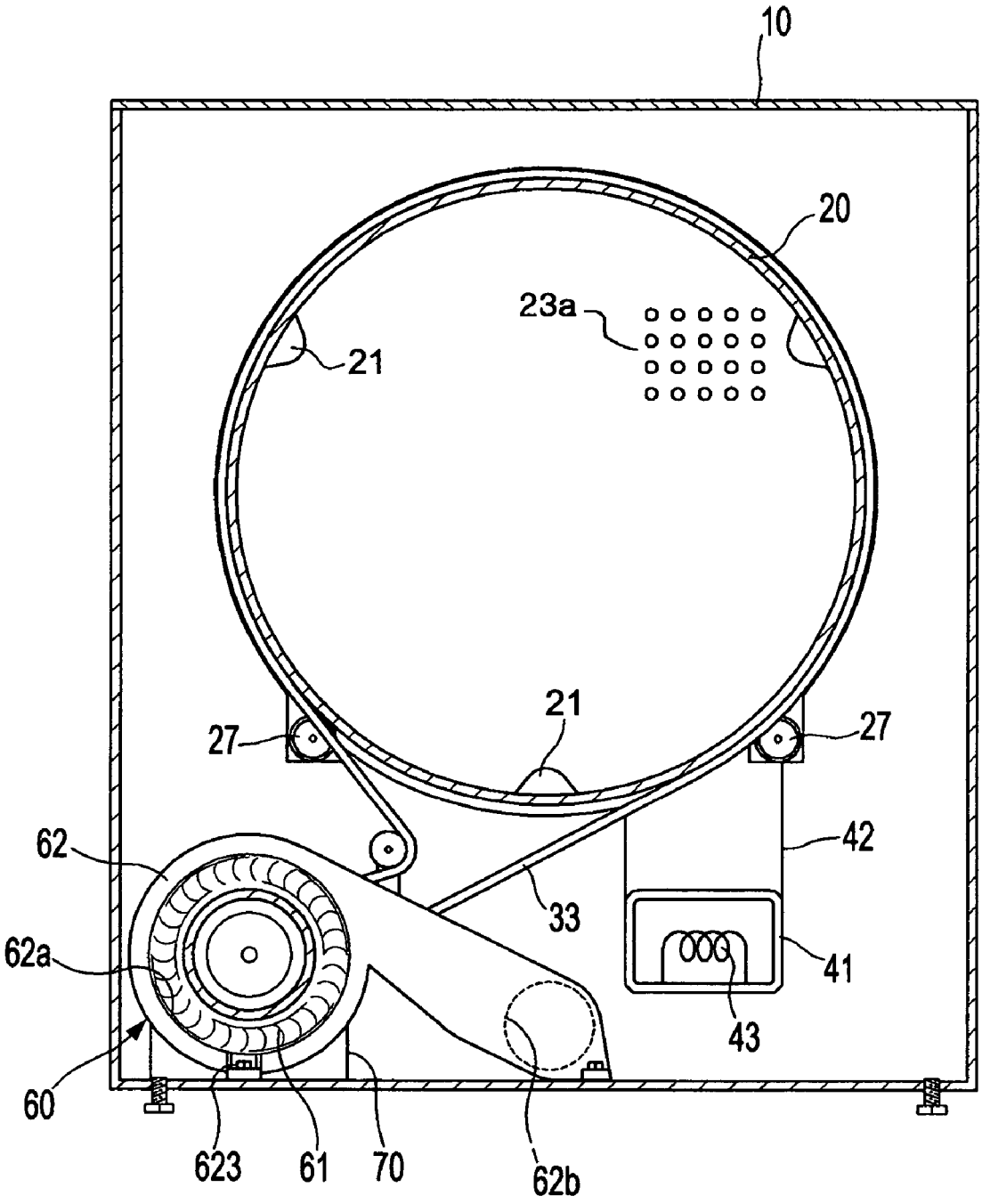
FIG. 2 is a sectional view taken along the line II-II' of FIG. 1.

The air blowing device 60 includes an air blast fan 61 installed at the shaft 34 (the shaft extended to the direction of opposite to the pulley) of the driving motor 31 driving the rotary drum 20, and an air blowing case 62 surrounding the air blast fan 61 and having an inlet 62*a* and an outlet 62*b* (with reference to FIG. 2), which are respectively connected to the front and rear discharge ducts 51 and 52.

By the above construction, the rotary drum 20 is rotated by the driving of the driving motor 31 in a general drying mode of the clothes drying machine, the laundry contained in the rotary drum 20 is lifted and then dropped by the rotation of the rotary drum 20, and external air is circulated into the rotary drum 20, thereby rapidly drying the laundry in the rotary drum 20.

The blowing of the air will be described as follows. Damp air in the rotary drum 20 is discharged to the outside through the front discharge duct 51, the air blowing case 62, and the rear discharge duct 52, and new air in the same amount as that of the discharged air is introduced to the inside of the rotary drum 20 through the lower suction duct 41 and the rear suction duct 42. The air inhaled through the lower suction duct 41 is heated by the heater 43, and is then introduced to the inside of the rotary drum 20, thereby rapidly drying the laundry in the rotary drum 20.

Figure 3:
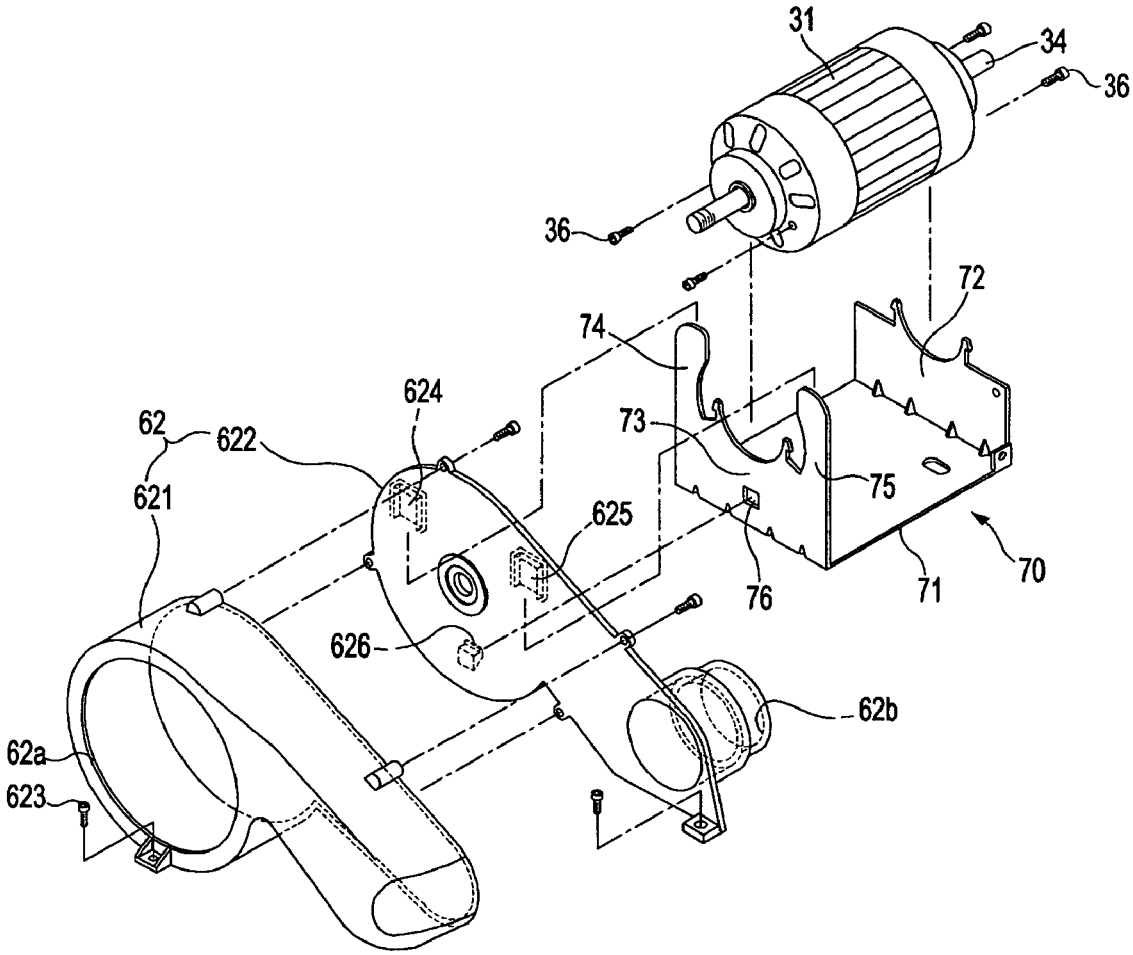
FIG. 3 is an exploded perspective view illustrating an air blowing case and a motor bracket of the clothes drying machine of the present invention.
Figure 4:
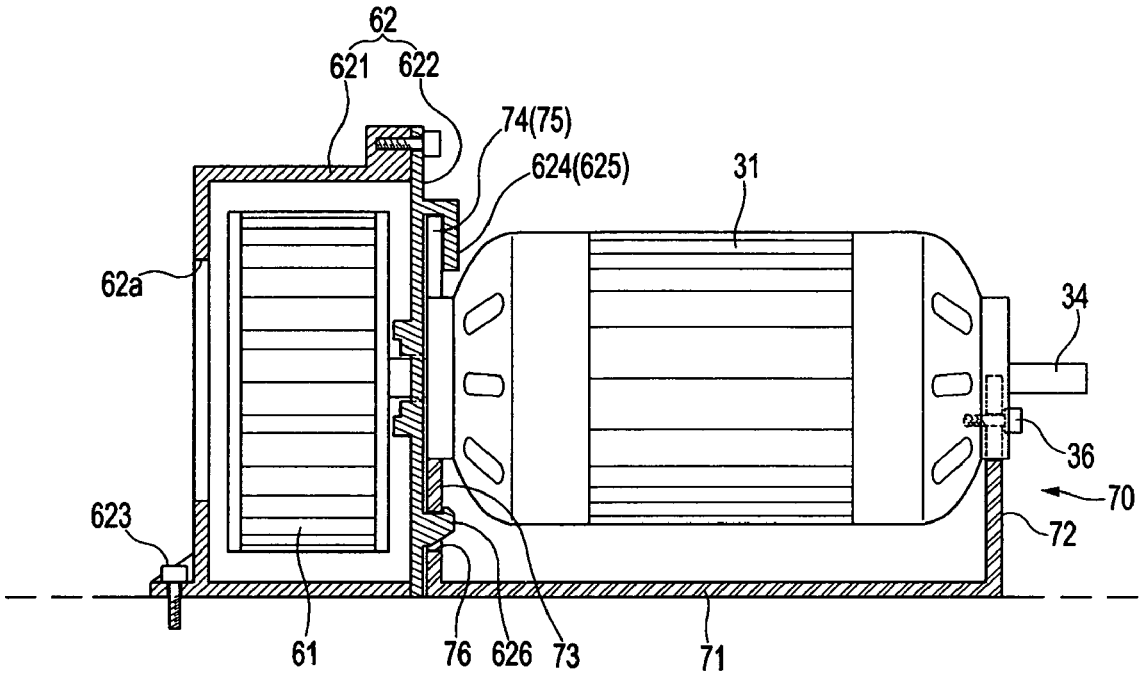
FIG. 4 is a sectional view illustrating the installation structure of the air blowing case and the motor bracket of the clothes drying machine of the present invention.

As shown in FIGS. 3 and 4, the driving motor 31 rotating the air blast fan 61 and the rotary drum 20 is fixed to a motor bracket 70 which is fixed to the bottom surface of the external case 10. The motor bracket 70 includes a base portion 71 fixed to the bottom surface of the external case 10, and motor supporting portions 72 and 73 extended upwardly from both sides of the base portion 71 for supporting both sides of the driving motor 31. The base portion 71 is fixed to the bottom surface of the external case 10 by a plurality of fixing screws, and the driving motor 31 is fixed to the motor supporting portions 72 and 73 formed at both sides of the motor bracket 70 by fixing screws 36.

As shown in FIGS. 3 and 4, the air blowing case 62 of the air blowing device 60 includes a body portion 621 surrounding the circumference of the air blast fan 61 for guiding air to be blown, and a rear plate 622 connected to the body portion 621 for covering the rear surface of the body portion 621. The air blowing case 62 is firmly supported by fixing the lower end of the body portion 621 to the bottom surface of the external case 10 by a fixing screw 623 and fixing the rear plate 622 to the motor bracket 70.

A first support portion 74 and a second support portion 75 for connecting the motor bracket 70 to the rear plate 622 of the air blowing case 62 are extended upwardly from both sides of the base portion 71 close to the air blowing case 62. First insertion portions 624 and 625 having a cap structure, the lower surface of which is opened, are installed on both sides of the upper part of the rear plate 622 of the air blowing case 62 such that the upper ends of the first support portion 74 and the second support portion 75 are inserted into the first insertion portions 624 and 625.

A second insertion portion 626 having a hook structure protruded to the motor support portion 73 of the motor bracket 70 is installed on the central portion of the lower part of the rear plate 622, and an insertion hole 76, into which the second insertion portion 626 is inserted, is formed through the motor support portion 73 at a position corresponding to the second insertion portion 626. The first insertion portions 624 and 625 formed on both sides of the upper part of the rear plate 622 and the second insertion portion formed on the central portion of the lower part of the rear plate 622 are molded integrally with the rear surface 622 when the rear plate 622 is manufactured by injection-molding a resin material.

When the air blowing case 62 having the above structure is fixed to the motor bracket 70 in a process of manufacturing the clothes drying machine, the first and second support portions 74 and 75 extended from the motor bracket 70 are inserted into the first insertion portions 624 and 625 formed on both sides of the upper part of the rear plate 622 of the air blowing case 62, and the second insertion portion 626 of the rear plate 622 enters the insertion hole 76 of the motor support portion 73. This connection structure allows the air blowing case 62 to be easily installed on the motor bracket 70 without using a fixing screw.

Further, since the upper ends of the first and second support portions 74 and 75 extended upwardly from both sides of the motor bracket 70 are inserted into the first insertion portions 624 and 625 of the rear plate 622 of the air blowing case 62, and the second insertion portion 626 is inserted into the insertion hole 76, the air blowing case 62 is firmly connected to a precise position of the motor bracket 70. This connection structure solves problems, such as shaking or vibration of the air blowing case, which conventionally occurred due to loosening of fixing screws.

As apparent from the above description, the present invention provides a clothes drying machine, in which upper ends of first and second support portions extended from a motor bracket are inserted into first insertion portions formed on both sides of a rear plate of an air blowing case and a second insertion portion formed on the rear plate enters and is inserted into the insertion hole of a motor support portion of the motor bracket so that the air blowing case is easily fixed to the motor bracket without a fixing screw, thereby reducing the number of components and improving assembly efficiency.

Further, since the first insertion portions have a cap structure so that the upper ends of the first and second support portions are covered by the first insertion portions and the second insertion portion is inserted into the insertion hole of the motor support portion, the air blowing case is precisely connected to the motor bracket. Thereby, the clothes drying machine of the present invention prevents the generation of noise or vibration due to an incorrect connection between the air blowing case and the motor bracket.

Although an exemplary embodiment of the invention has been shown and described, it will be appreciated by those skilled in the art that changes may be made in this embodiment without departing from the principles and spirit of the invention, the scope of which is defined in the claims and their equivalents.

What is claimed is:

1. A clothes drying machine comprising:

an air blowing device including an air blast fan and an air blowing case;

a driving motor installed proximate to the air blowing case for driving the air blast fan;

a motor bracket for fixing the driving motor;

a support portion extended from the motor bracket for fixing the air blowing case and determining the position of the air blowing case;

first insertion portions, formed on an outer surface of, and connected directly to, the air blowing case, into which the end of the support portion is inserted; and a second insertion portion protruded from the outer surface of the air blowing case at a position separated from the first insertion portions for fixing the air blowing case.

2. The clothes drying machine as set forth in claim 1, wherein the support portion further comprises an insertion hole formed there-through at a position corresponding to that of the second insertion portion.

3. The clothes drying machine as set forth in claim 2, wherein the motor bracket includes a base portion fixed to an external case of the clothes drying machine; and the support portion includes a first support portion and a second support portion upwardly extended from both sides of the base portion.

4. The clothes drying machine as set forth in claim 3, wherein the first insertion portions are formed at positions corresponding to the first and second support portions respectively, and have cap structures surrounding ends of the first and second support portions.

5. The clothes drying machine as set forth in claim 3, wherein:

the support portion further includes a motor support portion extended upwardly from the base portion at a position between the first and second support portions for supporting the driving motor; and the insertion hole is formed through the motor support portion.

6. The clothes drying machine as set forth in claim 2, wherein the second insertion portion is a protrusion having a hook structure inserted into and latched onto the insertion hole.

7. The clothes drying machine as set forth in claim 1, wherein:

the air blowing case includes a body portion surrounding the circumference of the air blast fan, and a rear plate covering the rear surface of the body portion and fixed to the support portion extended from the motor bracket; and the first and second insertion portions are formed on the rear plate.

8. The clothes drying machine as set forth in claim 7, wherein the rear plate and the first and second insertion portions are integrally formed by injection-molding a resin material.

* * * * *